US006953365B2

(12) United States Patent
Tabata et al.

(10) Patent No.: US 6,953,365 B2
(45) Date of Patent: Oct. 11, 2005

(54) TERMINAL FITTING WITH SEAL PROTECTING FEATURES

(75) Inventors: Masaaki Tabata, Yokkaichi (JP); Yuujirou Imai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/786,869

(22) Filed: Feb. 24, 2004

(65) Prior Publication Data

US 2004/0171304 A1 Sep. 2, 2004

(30) Foreign Application Priority Data

Feb. 28, 2003 (JP) ..... 2003-053313

(51) Int. Cl.[7] ..... H01R 13/40
(52) U.S. Cl. ..... 439/587; 439/275; 439/442
(58) Field of Search ..... 439/587, 588, 439/273, 275, 442, 421, 877, 878

(56) References Cited

U.S. PATENT DOCUMENTS 5,356,312 A * 10/1994 Abe et al. ..... 439/587
5,519,170 A * 5/1996 Nabeshima ..... 174/74 R
5,824,962 A 10/1998 Katsuma ..... 174/135
6,558,208 B2 * 5/2003 Suzuki ..... 439/878
2002/0171207 A1 11/2002 Torii et al. ..... 277/607

FOREIGN PATENT DOCUMENTS

| | | |
|---|---|---|
| JP | 2002-050431 | 2/2002 |
| JP | 2002-190347 | 7/2002 |
| JP | 2002-203636 | 7/2002 |

* cited by examiner

*Primary Examiner*—Hae Moon Hyeon
(74) *Attorney, Agent, or Firm*—Gerald E. Hespos; Anthony J. Casella

(57) ABSTRACT

A female terminal fitting (20) is provided with a pair of fastening pieces (26) extending from the opposite side edges of a bottom plate (24), and the fastening pieces (26) are bent inward toward each other, thereby wrapping around the outer circumferential surface of a sealing member (30) fitted on a wire (10) to fasten the sealing member (30) together with the wire (10). Sealing-member protecting portions (27) are formed on side edges of the inner surfaces of the fastening pieces (26) and are aligned at obtuse angles to contact surfaces (29). Therefore, the bite in the sealing member (30) can be hindered over a wide range.

9 Claims, 6 Drawing Sheets

TERMINAL FITTING WITH SEAL PROTECTING FEATURES

BACKGROUND OF THE INVENTION

1. Field of the Invention

The invention relates to a terminal fitting to be crimped into connection with both a sealing member and a wire.

2. Description of the Related Art

Japanese Unexamined Patent Publication No. 2002-203636 discloses a terminal fitting for use in a watertight connector. The terminal fitting has a wire barrel for crimped connection with a core of a wire and an insulation barrel for crimped connection with a sealing member. Fastening pieces extend from opposite side edges of a bottom plate of the insulation barrel. The respective fastening pieces are bent in towards each other and are crimped around the outer circumferential surface of the sealing member.

The inner side edges of the fastening pieces of the prior art terminal fitting may bite into the outer surface of the sealing member and may crack the fastened portion of the sealing member.

The present invention was developed in view of the above problem and an object thereof is to prevent a sealing member from being damaged.

SUMMARY OF THE INVENTION

The invention relates to a terminal fitting with a base and at least one fastening piece that extends from a side edge of the base. The fastening piece is configured to be crimped, bent, folded or wrapped at least partly around the outer circumferential surface of a seal fit on a wire and has a contact surface that faces the seal and the wire. Thus, the seal is fastened together with the wire. At least one seal protecting portion is formed at a corner or lateral portion of the contact surface of the fastening piece and is aligned at an obtuse angle to the contact surface of the fastening piece.

The seal is squeezed when the fastening piece is crimped into connection with the seal and the wire, and the fastening piece strongly presses the outer surface of the seal. However, the seal protecting portion is formed at the corner of the contact surface and is aligned at an obtuse angle to the contact surface of the fastening piece. Thus, the fastening piece will not bite into the seal and there is no possibility of cracking the seal.

The seal protecting portion preferably is formed over substantially the entire side edge of the inner surface of the fastening piece. Thus, the bite into the seal can be hindered over a wide range.

The contact surface of the fastening pieces preferably are to be crimped to partly deform the seal for fastening the seal together with the wire. However, the seal protecting portions are at obtuse angles to the contact surfaces and are at positions where they are substantially not in contact with the seal.

Two or more fastening pieces preferably are provided at displaced positions along a longitudinal direction of the terminal fitting.

A rear edge of the bottom plate preferably is a portion previously coupled to and then separated from a carrier. The rear edge is not formed with the seal protecting portion.

The fastening piece preferably is provided at a lateral end portion of the base plate.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female terminal fitting according to the invention is identified by the numeral 20 in FIGS. 1 to 7. The female terminal fitting 20 is to be connected with a wire 10 having a seal 30 fit thereon.

Figure 1:
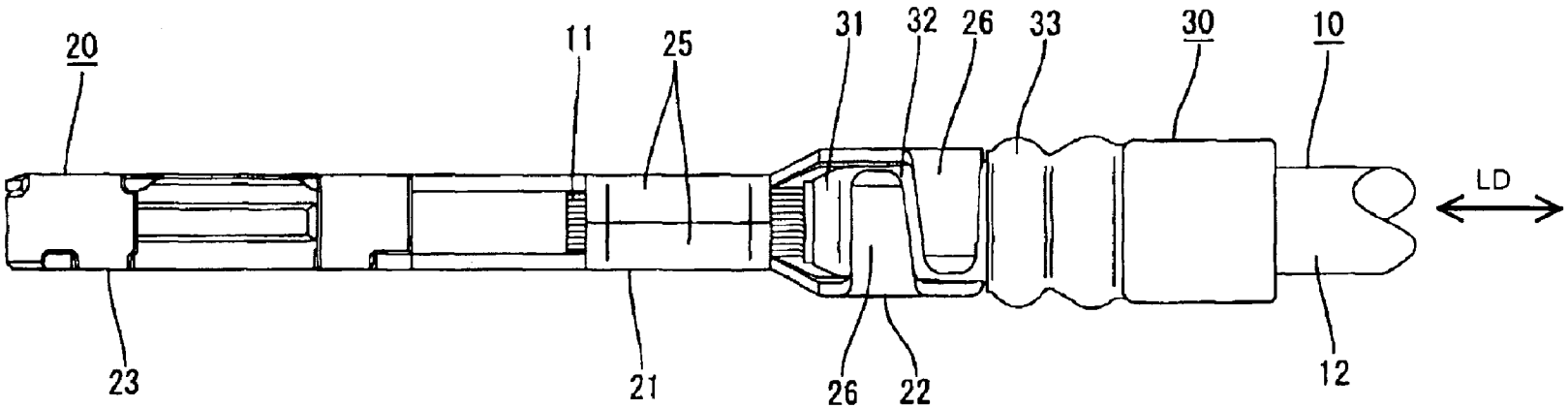
FIG. 1 is a plan view showing a terminal fitting according to one embodiment of the invention.
Figure 2:
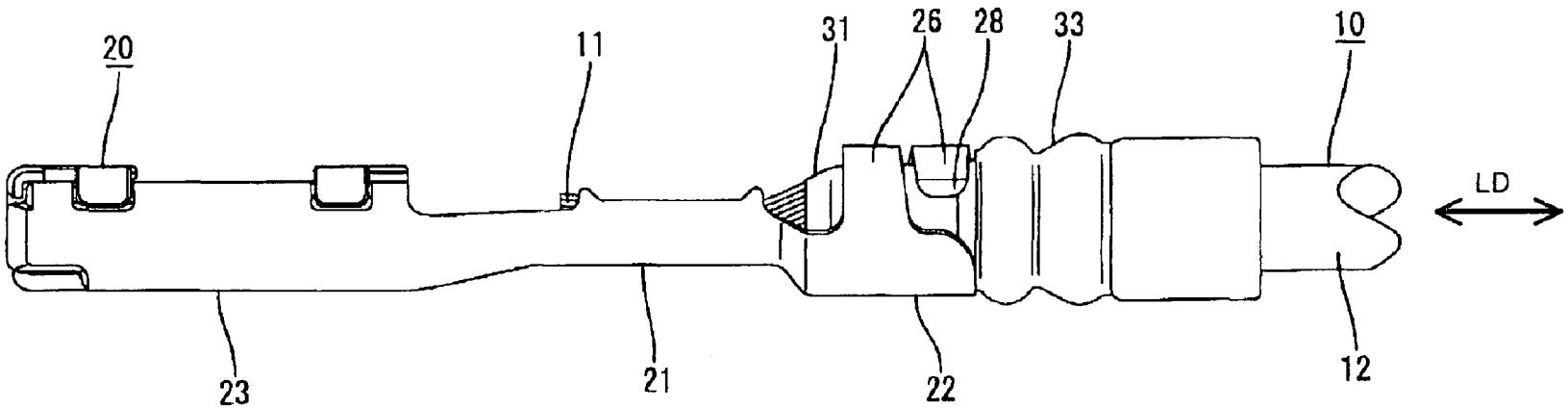
FIG. 2 is a side view of the terminal fitting.

The wire 10 includes a core 11 preferably made of a plurality of fine metal strands and an insulation coating 12 that covers the core 11, as shown in FIG. 1. The core 11 is exposed along a specified length by having the insulation coating 12 stripped at an end portion. In the following description, a side of the wire 10 where the core 11 is exposed and a side thereof covered by the insulation coating 12 are referred to as front and rear sides with respect to the longitudinal direction LD of the wire 10.

The seal 30 is formed of a sealing material, and preferably a rubber material such as a silicon rubber. The seal 30 has a tubular shape, and is dimensioned to be fit and resiliently held in surface contact on the outer circumferential surface of the insulation coating 12 of the wire 10. The seal 30 has a small-diameter portion 31, a mounting portion 32 and a plurality of lips 33 arranged substantially coaxially along the longitudinal direction LD one after another from the front side. The lips 33 bulge outward near the rear of the seal 30 and are arranged one after another along the longitudinal direction LD of the wire 10. The mounting portion 32 has a substantially cylindrical shape, and an insulation barrel 22 of the female terminal fitting 20 is to be crimped, bent or folded into connection with the outer circumferential surface of the mounting portion 32. The small-diameter portion 31 is tapered toward the front to have a converging substantially conical outer circumferential surface. Thus, even if the small-diameter portion 31 flares out as the insulation barrel 22 is crimped into connection, the small-diameter portion 31 does not get caught by the inner wall of a cavity (not shown) of a connector housing when the female terminal fitting 20 is inserted into the cavity. Further, the front surface of the small-diameter portion 31 is substantially flush with the front end of the insulation coating 12.

Figure 3:
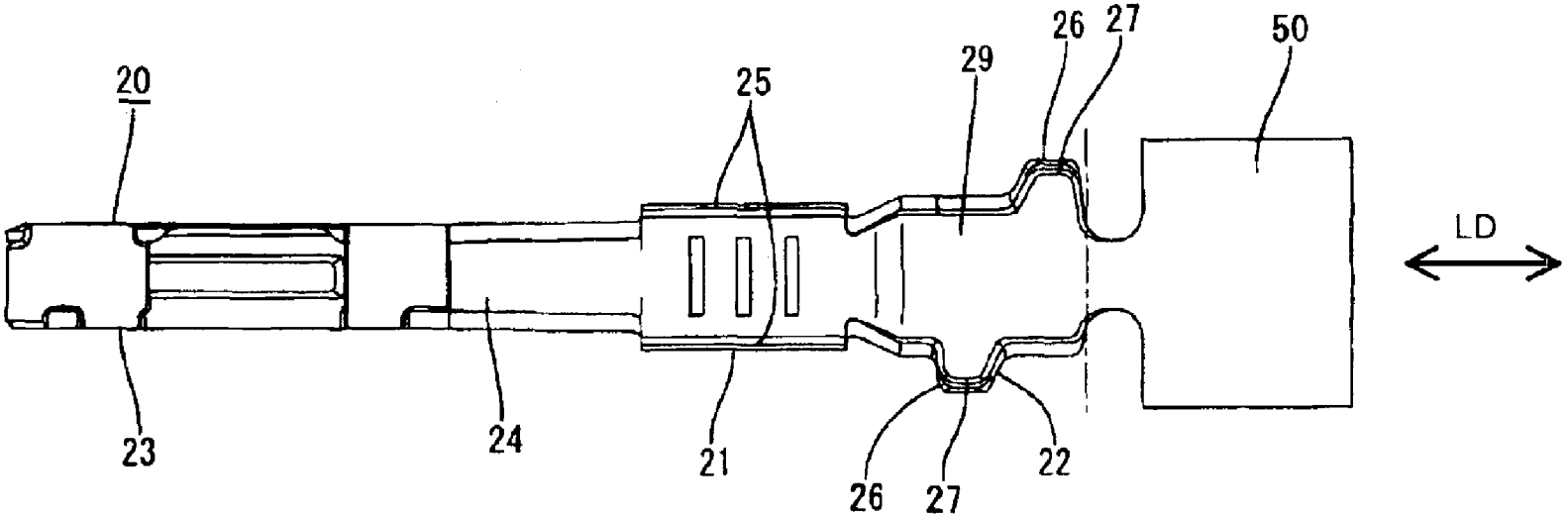
FIG. 3 is a plan view showing a state of the terminal fitting coupled to a carrier before crimping.
Figure 4:
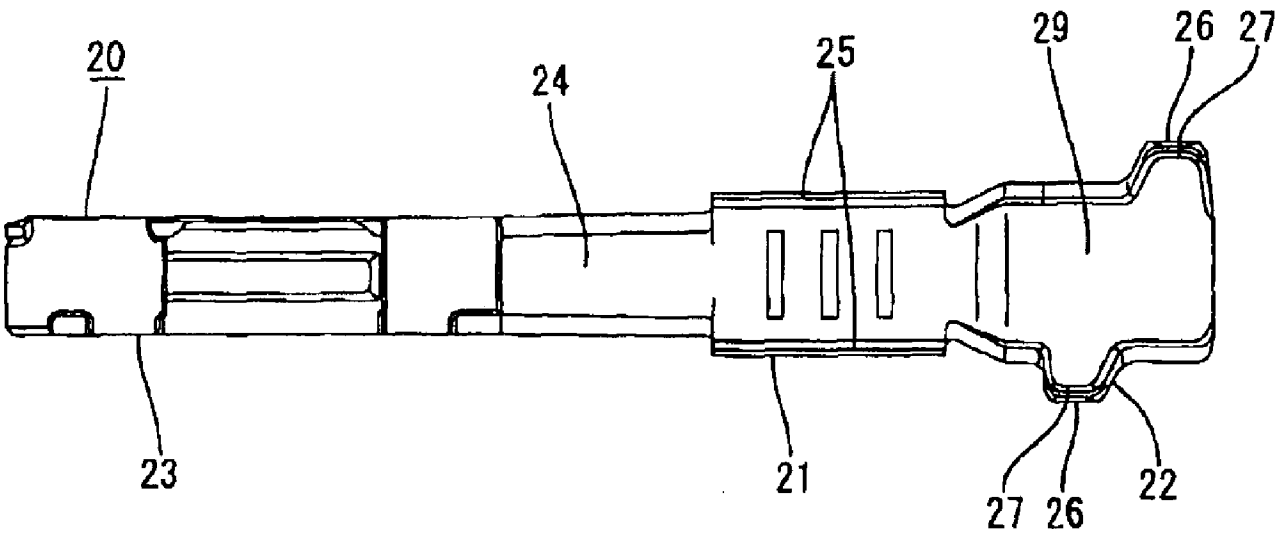
FIG. 4 is a plan view showing a state of the terminal fitting separated from the carrier before crimping.

The female terminal fitting 20 is formed into a state shown in FIG. 3 by press-working a conductive (metallic) plate, and the wire barrel 21 and the insulation barrel 22 are arranged one after the other behind a substantially boxshaped main portion 23. The main portion 23, the wire barrel 21 and the insulation barrel 22 are successively provided while sharing a bottom plate 24 that is long along forward and backward or longitudinal directions LD.

The main portion 23 has a substantially open front surface so that a mating male terminal fitting (not shown) is insertable therein from the front. A tongue projects from the front edge of the bottom plate 24 and is folded back in the main portion 23 to form a resilient contact piece (not shown) that can be brought resiliently into contact with the male terminal fitting inserted into the main portion 23.

The wire barrel 21 includes left and right projecting pieces 25 that extend from the opposite side edges of the bottom plate 24. The respective projecting pieces 25 extend substantially along the longitudinal direction LD of the wire 10 and are crimped, bent or folded to wrap at least partly around the core 11 placed on the bottom plate 24.

Figure 5:
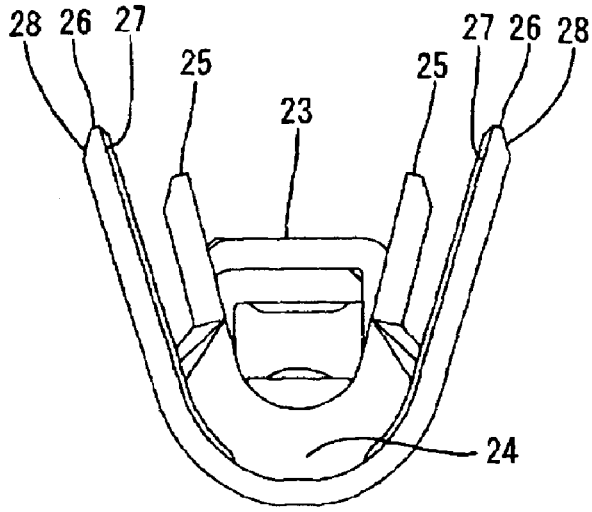
FIG. 5 is a rear view showing the terminal fitting before crimping.
Figure 6:
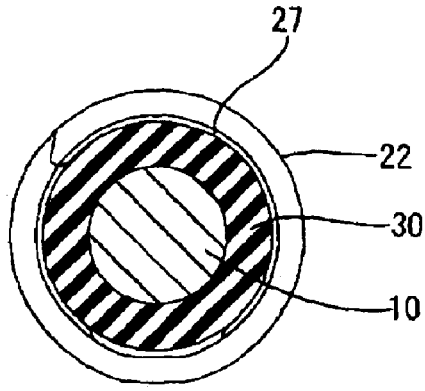
FIG. 6 is a section showing a state of an essential portion of the terminal fitting after crimping.
Figure 7A:
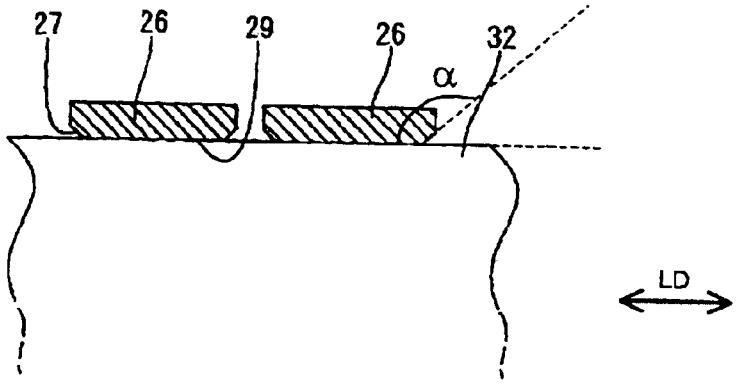
FIG. 7 is a section of an essential portion showing a positional relationship of contact surfaces and sealing-member protecting portions.
Figure 7B:
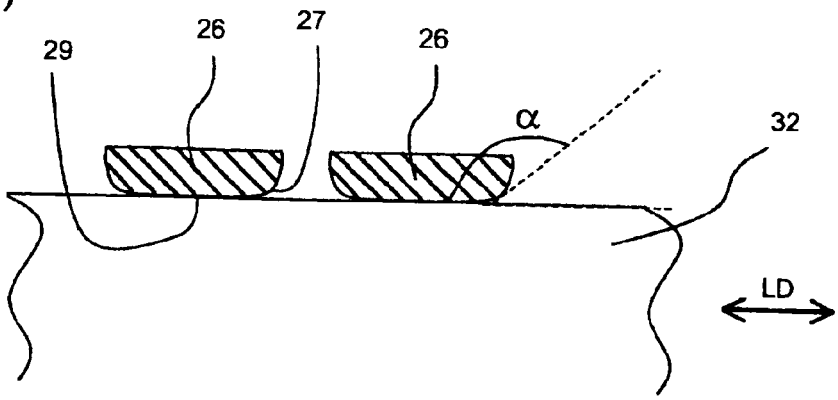

The insulation barrel 22 has left and right fastening pieces 26 that extend from opposite side edges of the bottom plate 24. The fastening pieces 26 are displaced along the longitudinal direction LD. Thus, the left fastening piece 26 in FIG. 1 extends from a front part of the bottom plate 24, whereas the right fastening piece 26 in FIG. 1 extends from a rear part of the bottom plate 24. A slanted or rounded surface is formed at the edge of the inner surface of each fastening piece 26 to forming a seal protecting portion 27. More particularly, the front and rear edges facing towards the seal 30 in the folded configuration are slanted (FIG. 7(A)) or rounded (FIG. 7(B)) to protect the seal 30 from damage. The seal protecting portion 27 of this embodiment is formed at the edges of the inner surfaces of the respective fastening pieces 26 and also on the opposite side edges of the inner surface of the bottom plate 24 substantially continuous with the base ends of the fastening pieces 26. On the other hand, areas of the inner surfaces of the fastening pieces adjacent the seal protecting portions 27 define contact surfaces 29 for contacting the outer circumferential surface of the seal 30, as shown in FIG. 7. Thus, the seal protecting portions 27 are substantially continuous with the contact surfaces 29, but at least intermediate areas of the seal protecting surfaces 27 are at acute angles $\alpha$ to the contact surfaces 29. In FIG. 7(A), the seal protecting portions 27 are slanted or beveled planar surfaces that are inclined at an acute angle $\alpha$ over the full extension of the seal protecting portions 27. In FIG. 7(B) the seal protecting portions 27 are rounded and the tangential line at an intermediate portion of the seal protecting portion 27 defines an acute angle $\alpha$ to the respective contact surface 29 or the longitudinal direction FD. The edge of the outer surface at the extending end of each fastening piece 20 is a slanted or rounded surface 28 as shown in FIG. 5.

The respective fastening pieces 26 are to be crimped, bent or folded to wrap around at least part of the mounting portion 32 of the seal 30 placed on the bottom plate 24 in a direction substantially normal to the longitudinal direction LD of the wire 10. In this fastening state, the contact surfaces 29 of the fastening pieces 26 are in close contact with the outer circumferential surface of the mounting portion 32 of the seal 30, whereas the seal protecting portion 27 of the fastening pieces 26 face the outer circumferential surface of the mounting portion 32 of the seal 30 without being held in pressing contact.

The female terminal fitting in the state shown in FIG. 3 is formed by stamping or cutting a metallic plate and working the metallic plate into a specified shape by a press. Then, a portion (portion shown by phantom in FIG. 3) at the rear edge of the bottom plate 24 and coupled to a carrier 50 is cut to separate the female terminal fitting 20 from the carrier 50. During this time, the insulation coating 12 at the end of the wire 10 is stripped to expose the core 11 and the seal 30 is fitted on the end of the insulation coating 12. Then, the wire 10 and the seal 30 are placed on the bottom plate 24 of the female terminal fitting 20. At this time, the core 11 is aligned with the wire barrel 21 and the mounting portion 32 of the seal 30 is aligned with the insulation barrel 22. The rear edge of the bottom plate 24 had been coupled to the carrier 50 and was cut. Thus, the rear edge of the bottom plate 24 is not formed with the seal protecting portion 27. Of course, the rear edge of the bottom plate 24 may be beveled after separation from the carrier 50. Then, the sealing-member protecting portion 27 is formed over substantially the entire edge of the inner surface of the insulation barrel 22.

The wire barrel 21 and the insulation barrel 22 then are crimped, bent or folded to wrap at least partly around the core 11 and the mounting portion 32 of the seal 30 using an unillustrated jig. The wire barrel 21 is crimped so that the leading ends of the respective projecting pieces 25 contact, bite or engage in the middle of the core 11. As a result that an electrical connection is established between the female terminal fitting 20 and the wire 10.

The insulation barrel 22 is crimped, bent or folded so that the fastening pieces 26 are bent in with respect to the mounting portion 32 of the seal 30 to fasten the mounting portion 32. The respective fastening pieces 26 tightly hold the seal 30 and the wire 10 together while squeezing the mounting portion 32 of the seal 30. In this state, the contact surfaces 29 of the fastening pieces 26 contact the outer circumferential surface of the mounting portion 32 of the seal 30. However, the seal protecting portions 27 on the inner surfaces of the fastening pieces 26 are at the outer side of the outer circumferential surface of the mounting portion 32, as shown in FIG. 7. In other words, the seal protecting portions 27 are at positions where they are substantially not in contact with the mounting portion 32 of the seal 30, and there is no possibility that the side edge corners of the fastening pieces 26 will bite in the seal 30. Thus, cracks and other such damage of the seal 30 can be prevented.

Thereafter, the female terminal fitting 20 connected with the wire 10 is accommodated in the cavity (not shown) of the connector housing. The inside of the cavity can be held watertight by the lips 33 of the seal 30 being held in close contact with the inner circumferential surface of the cavity.

As described above, according to this embodiment, the seal 30 can be fastened together with the wire 10 by the contact surfaces 29 of the fastening pieces 26 strongly pressing the outer circumferential surface of the seal 30, whereas the seal protecting portions 27 at obtuse angles $\alpha$ to the contact surfaces 29 are at positions where they are substantially not in contact with the outer circumferential surface of the seal 30, thereby preventing the bite in the seal 30. As a result, a crack in the seal 30 can be prevented. Further, since the seal protecting portions 27 are formed over substantially the entire side edges of the inner surfaces of the fastening pieces 26, the bite in the seal 30 can be hindered over a wide range and the seal 30 can be more securely prevented from being cracked.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the female terminal fitting is illustrated in the foregoing embodiment, the invention is also applicable to male terminal fittings.

It is sufficient for the seal protecting portions to be at obtuse angles $\alpha$ to the corner portions of the contact surfaces with the seal, and they need not be slanted surfaces (see FIG. 7(A)) of a specified angle $\alpha$. For example, the seal protecting portions may be curved surfaces with tangents in an intermediate position at acute angles $\alpha$ to the contact surfaces (see FIG. 7(B)).

The seal protecting portions are formed over the entire side edges of the inner surfaces of the fastening pieces in the foregoing embodiment. However, the seal protecting portions may be only at the side edges of the inner surfaces at the extending ends of the fastening pieces because these areas are thought to have stronger forces to deform and bite into the seal.

Contact between the terminal fitting and the wire is established by crimping a wire barrel onto the wire in the above-embodiment. However the invention is applicable to terminal fittings in which the contact is established by other means such as by insulation displacement, soldering, etc.

What is claimed is:

1. A terminal fitting, comprising: a base having opposite side edges extending parallel to a longitudinal direction, fastening pieces extending respectively from the side edges of the base and configured to be crimped at least partly around an outer circumferential surface of a seal fit on a wire and positioned on the base, each of the fastening pieces having a contact surface extending substantially parallel to the longitudinal direction for contacting the seal, an outer surface facing oppositely from and parallel to the contact surface, a side edge aligned perpendicular to the outer surface and extending from the outer surface towards the contact surface and a seal protecting surface extending between the side edges and the contact surface, the seal protecting surfaces being aligned at an obtuse angle to the contact surface of the fastening piece for avoiding biting contact with the seal.

2. The terminal fitting of claim 1, wherein the seal protecting surface is formed over substantially entire side edges adjacent the contact surface of each of the fastening pieces.

3. The terminal fitting of claim 1, wherein the seal protecting surfaces extending linearly at the obtuse angle to the contact surface of the fastening piece.

4. The terminal fitting of claim 1, wherein the seal protecting surfaces are curved and have tangents aligned at the acute angle to the contact surface of the fastening piece.

5. A terminated wire, comprising:

a wire having a longitudinal direction and an end, a conductive core extending along the longitudinal direction from the end and an insulation coating surrounding at least a portion of the core;

a substantially tubular seal mounted over the insulation coating in proximity to the end of the wire, the seal having an outer circumferential surface; and a terminal fitting having base extending along the longitudinal direction and engaging a portion of the outer circumferential surface of the seal, the base having opposite side edges, fastening pieces extending respectively from the side edges of the base and crimped at least partly around the outer circumferential surface of the seal, the fastening pieces being spaced from one another along the longitudinal direction, each of the fastening pieces having a contact surface extending substantially parallel to the longitudinal direction and contacting the outer circumferential surface of the seal, and seal protecting surfaces disposed on the fastening pieces along edges of the contact surfaces, the seal protecting surfaces being aligned at an obtuse angle to the contact surface of the fastening piece for avoiding biting contact with the seal.

6. The terminal fitting of claim 5, wherein the seal protecting surfaces extend linearly at the obtuse angle to the contact surface of the fastening piece.

7. The terminal fitting of claim 5, wherein the seal protecting surfaces are curved and have tangents aligned at the obtuse angle to the contact surface of the fastening piece.

8. The terminal fitting of claim 5, wherein the seal protecting portion is formed over substantially entire side edges adjacent the contact surface of each of the fastening pieces.

9. The terminal fitting of claim 5, wherein each of the fastening pieces has an outer surface aligned substantially parallel to the contact surface and an edge aligned substantially perpendicular to the outer surface and extending from the outer surface to the seal protecting portion.

* * * * *